US005692742A

United States Patent [19]

Tranquilla

[11] Patent Number: 5,692,742

[45] Date of Patent: Dec. 2, 1997

[54] DOCUMENT TRANSPORT WITH ADJUSTABLE GAP

[75] Inventor: Michael N. Tranquilla, Livonia, Mich.

[73] Assignee: Unisys Corp, Blue Bell, Pa.

[21] Appl. No.: 744,080

[22] Filed: Nov. 4, 1996

Related U.S. Application Data

[62] Division of Ser. No. 343,695, Nov. 21, 1994, Pat. No. 5,575,466.

[51] Int. Cl.[6] ..... B65H 5/00

[52] U.S. Cl. ..... 271/10.03; 271/265.01

[58] Field of Search ..... 271/10.03, 10.09, 271/110, 258.01, 258.02, 258.03, 265.01, 270, 272–274

[56] References Cited

U.S. PATENT DOCUMENTS

| | | | |
|---|---|---|---|
| 4,331,328 | 5/1982 | Fasig | 271/270 |
| 4,451,027 | 5/1984 | Alper | 271/122 |
| 4,691,912 | 9/1987 | Gillmann | 271/10.03 X |
| 5,018,716 | 5/1991 | Yoshida et al. | 271/227 |
| 5,094,442 | 3/1992 | Kamprath et al. | 271/227 |
| 5,121,915 | 6/1992 | Duncan et al. | 271/111 |
| 5,186,449 | 2/1993 | Ohmi et al. | 271/111 X |
| 5,197,726 | 3/1993 | Nogami | 271/110 |
| 5,575,466 | 11/1996 | Tranquilla | 271/10.03 |

*Primary Examiner*—David H. Bollinger
*Attorney, Agent, or Firm*—John McCormack

[57] ABSTRACT

Apparatus for transporting and processing documents and maintaining a preset nominal inter-document gap, $g_{nom}$ therebetween, this apparatus including a transport stage for picking each document from an input stack and advancing it toward a destination at a controlled rate; a sensor unit for sensing the distance g between the so-moved document and the following document; and a control stage for determining the variance $\nabla g$, between $g_{nom}$ and g, while driving each successive document along a feed path from the input stack at adjustable times; with the sensor unit inputting the control stage which is adapted to responsively determine the variance-distance $\nabla g$, and to thereupon control the transport stage to adjust the acceleration or deceleration of a following document and so tend to reduce this variance-distance $\nabla g$.

7 Claims, 3 Drawing Sheets

DOCUMENT TRANSPORT WITH ADJUSTABLE GAP

This is a Division of U.S. Ser. No. 08/343,695, filed Nov. 21, 1994, to issue as U.S. Pat. No. 5,575,466.

This invention relates to document processing equipment wherein documents are fed serially along a transport path, and particularly to variable pinch roll force for adjusting inter-document spacing along this path.

BACK GROUND, FEATURES

Document processing machinery should be designed to yield high speed document transport, yet there are limitations in how fast it can operate. For example, in a check sorter the electromechanical gates which open and close to direct a document into a selected pocket, can only operate so fast—so the interdocument gap becomes important. If the documents are fed too fast, a shortened gap will cause errors such as improper sorting or failure to sort.

And, if one increases document transport speed, this can increase the inter-document gap, but can result in document damage as well as processing and stacker errors.

A further problem is that components involved with the feeding of documents typically rely on mechanical friction, hence the components will wear away and change dimensions; also they are influenced by environmental factors such as temperature and humidity. One way to approach these problems is to choose an operating point which allows for contemplated wear and environmental concerns. While this can be effective, it implies some sacrifice of performance.

Another Way to allow for such variable factors is to keep the gap relatively constant between documents fed seriatim. (E.g., see U.S. Pat. Nos. 4,451,027 and 4,331,328.) Typically, document transports are limited in performance by the inertia of the pinch-rolls they must accelerate. These calling for a lot of power and apt to generate excessive heat. Other limitations and disadvantages of prior art systems are apparent to those skilled in the art of document processor control systems.

A general object hereof is to keep the inter-document gap constant.

Other Related Art is the Following

U.S. Pat. No. 5,197,726, directed to sheet transportation systems that calculate a target time for sheet arrival at a downstream position and vary the transport speed so that the sheet arrives at the desired time. The sheet feeder has a control unit that receives signals from sheet detectors and controls sheet transport by controlling the speed and time of selected motors; e.g., calculated so that the sheet arrives in time at a registration roller even though it was detained by the sheet feeder.

U.S. Pat. No. 5,094,442 is directed to a sheet positioning system that performs longitudinal and lateral alignment in a sheet path without guides or gates. A sheet is skew-registered by a unit having two drive rolls driven by separate speed control stepper motors. A sheet is aligned laterally by a carriage, which is positioned by a drive system that includes a speed controlled stepper motor and a lead screw. Detectors or sensors supply sheet position signals to a controller for determining appropriate drive signals to the motors for aligning the sheet.

U.S. Pat. No. 5,121,915 is directed to a document processor that has closed loop control of the feed rate, gaps, and input station so that more documents can be processed per minute, even as the mechanism changes because of wear and the environment. A system manager and separator processor card receive input from document sensors and performs a closed loop control of drive motors. The closed loop control includes velocity feedback from the motors to the processor.

U.S. Pat. No. 5,018,716 is directed to an automatic document feeder that adjusts the transportation speed based on the operational state of the transport mechanism. Documents are fed from a roll to a separation unit and then to a feed path. Sensors on the stacker for registration, and a sensor at the discharge point supply signals to a microcomputer for controlling the separation motor, belt motor, and carrier motor. Based on the first document that passes through the system, a learning feature thereafter adjusts the speed of the belt-motor for improved operation.

U.S. Pat. No. 5,186,449 is directed to a sheet feeder unit that calculates the sheet transportation speed to prevent sheet overlap. The sheet transport mechanism feeds copy paper from a unit past sensors, one being activated when the paper hits a feed roller. A control unit analyzes the sensor inputs and selects the appropriate sheet feeder interval.

It is an object hereof to alleviate such problems and provide at least some of the here-described features and advantages. A more particular object is to provide means to maintain constant spacing between documents of a document transport. Another object is to correct occasional small spacings that may occur due to improper feeding from a document stack. A more particular object is to keep document spacings relatively constant so as to maximize throughput (documents transported per unit time), and to keep minimum spacings large enough to permit reliable operation of pocket selector gates, microfilm film advances between spacings, and many other devices that rely on consistent uniform spacing between documents advanced serially.

And, preferably, document spacing is adjusted by varying the acceleration force on the documents in accordance with measured document spacing at the beginning of a space producing sequence.

Advantages Over Past Practice

Previous means of producing nearly constant document spacing involve complicated and expensive vacuum feeders with vacuums that must be switched on and off. Other means involve complicated and expensive feedback servo systems with individual motors driving rollers at differing accelerations to achieve spacing corrections.

Inexpensive friction devices may be used, but they are too sensitive to variations in friction between document transport rollers and documents of various papers and conditions.

This invention avoids the foregoing, merely adding a simple, variable accelerating means to a pinch roll assembly and a simple document edge detection system to change the document accelerating friction force when needed, while mounting its pinch roll on flexure means, or the like, to resiliently "pass" document "bulges" as well as facilitate acceleration/deceleration to reduce gap variation.

Other objects and advantages of the present invention will be apparent to those skilled in the art.

BRIEF DESCRIPTION OF THE DRAWINGS

The foregoing and other features and advantages of the present invention will be appreciated by workers as they become better understood by reference to the following detailed description of the present preferred embodiments, these being considered in conjunction with the accompanying drawings, wherein like reference symbols denote like elements.

DETAILED DESCRIPTION OF PREFERRED EMBODIMENT

Figure 1:
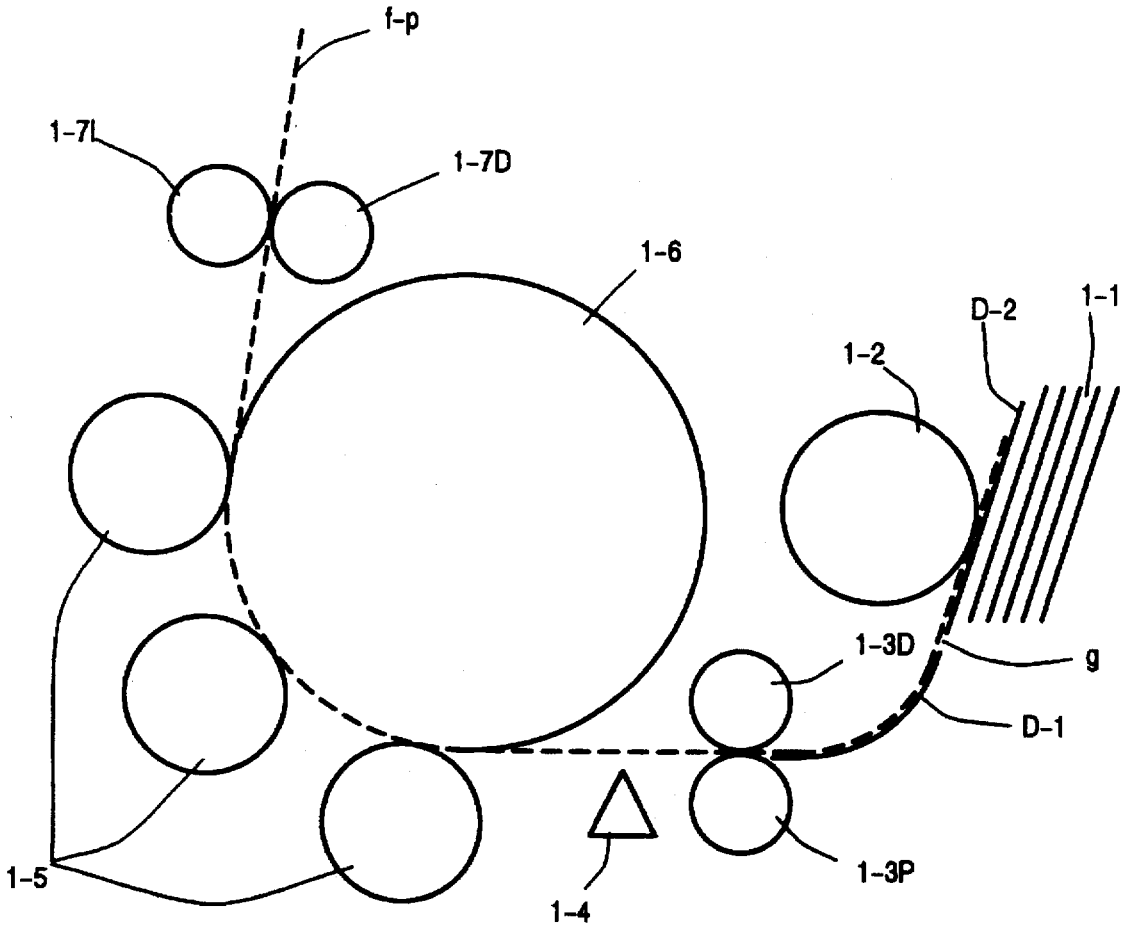
FIG. 1 is a very schematic, idealized showing of a document transport array, including drive rollers apt for use in the invention.

FIG. 1 shows a schematic view of a preferred document transport embodiment according to the present invention. The document transport may be understood to take checks, or other documents, from a stack 1—1 and move then along a feed path, using a picker, or feed wheel 1-2. Individual checks are carried along the feed path one at a time, past various sensors, readers, and alignment means, some of which will be described later, finally to a plurality of sort pockets. The sort pockets are not shown but well known. All of these items are generally well known in the art and form only the background against which the present invention is described).

Adjacent stack 1—1, feed wheel 1-2 includes a feed tire 1-2, which is operated to advance a single document from the stack into a nip formed between rolls 1-3D, 1-3P. Feed tire 1-2 thus serves to initiate each single document along the document feed path f-p, which will be understood to include serial sets of advance-rollers.

Typically, the document is to be transported at constant speed along document path f-p, to be read by magnetic or optical character recognition systems, and/or to be printed on, microfilmed, imaged, routed into other document transports (e.g., sort pockets) via selector gates, and stacked. Any of these actions may require a minimum space between successive documents to function properly, and can be upset by "underspacing". That is, occasionally, the space between two successive documents may fall below the requisite minimum gap $g_m$, creating an "underspace" condition, e.g., because of malfunctions in the feeding or aligning mechanisms. This may be due to poor document quality or condition. This invention detects the underspace after the document has been "picked" (by tire 23; e.g., and before it is aligned by the aligner mechanism 1-5, 1-6, etc., see FIG. 1), and acts to correct the variance in gap-size before the document reaches other downstream functional mechanisms in the transport.

Feed wheel 1-2 feeds documents one at a time from the stack into a document transport consisting of several rollers. Typically, the document is transported at constant speed along the document path. The documents may be read by magnetic or optical character recognition systems, printed on, microfilmed, imaged by computer systems, routed into other document transports via selector gates, and stacked in a pocket. Any one of these actions may require a minimum space between successive documents to function properly. Document spaces that are too large will result in reduced throughput.

Normally, feed wheel 1-2 feeds a document off the stack such that its leading edge is very close to (slightly behind) the trailing edge of the preceding document. The feed wheel quickly accelerates a document to a speed less than that of the remaining drive rollers in the transport. Upon being engaged in the first "higher-speed" transport rollers (normally called the accelerator rollers 1-3) and leaving the feed wheel pinch point, the document is accelerated to the final transport speed by the friction force that exists between the drive roller 1-3D and the document. This friction force is a product of the pinch roller force and the coefficient of friction between the drive roller and the document. This acceleration process produces space between the documents. This space can vary depending upon the accelerating friction force, and to some extent, the document lengths.

The coefficient of friction between documents and the accelerator drive roller varies depending the kind of paper used and the condition of the paper. In many devices, such as check sorters and mail sorters, a document stack may consist of many different kinds papers and paper conditions. This coefficient of friction variation can cause serious document spacing variation.

The spacing between documents is sensed at an edge detector 1-4 placed between the accelerator roller and the next downstream transport roller (which may be an aligner drum 1-6 as shown in this sketch). The edge detectors may function by any number of electromechanical means which are currently practiced.

If an underspace (or overspace) is detected between two successive documents (e.g., D-1, D-2), then the latter document will be decelerated (accelerated) by pinch roll 1-3P a certain amount, tending to reduce this deviation.

In the unlikely event that a succession of several underspaces is created (e.g., by the aligner or feeder), the above-described underspace correction device may not be able to keep up. But logic (computer) controls are provided to count these underspaces, and, in case of two (or N) successive underspaces, to stop the feeder, temporarily, to thereby open up a larger gap between documents.

This detector unit 1-4 is placed such that part of the acceleration process, but not all of it, has occurred. If the space measured between two documents is not "nominal" for the first part of the acceleration process, the pinch roll force is changed during the remaining part of the accelerating process to produce more or less document space, depending on whether the space measured is less or more than "nominal". [e.g., nominal 2" here.]

Figure 2:
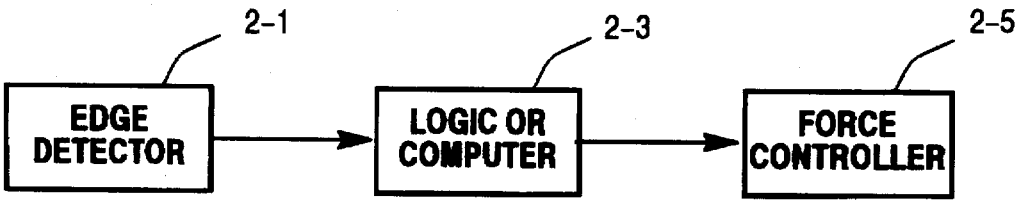
FIG. 2 is a block diagram of a preferred force-adjust system with FIG. 3 giving a related logic diagram.

FIG. 2 illustrates the preferred primary electrical control functions for the above.

Figure 3:
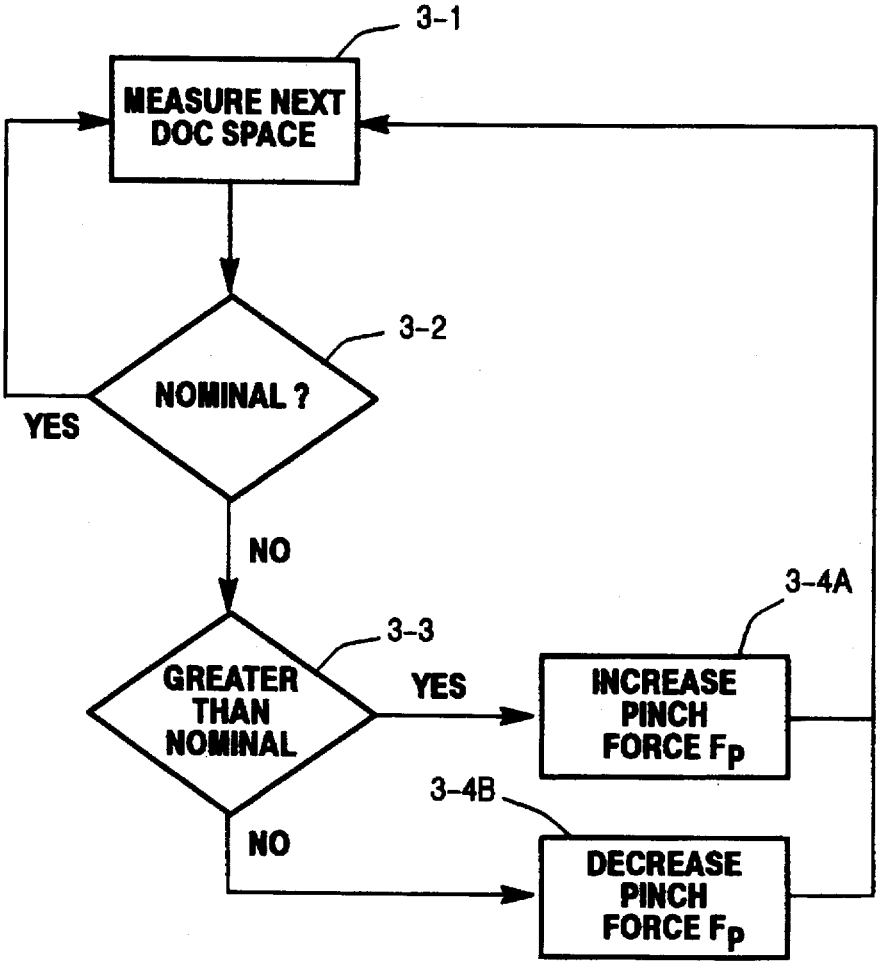

FIG. 3 illustrates the algorithm for actuating force controllers that can be accomplished, either with hardwired logic or with a computer.

FIG. 2 is a block diagram of (salient portions of) the preferred control system for this embodiment, whereby both the edge-detector unit provides input signals to a computer control block CB (or like logic, as known in the art), to control the position-shift of (the motor for) pinch rollers 1-3P, as well as to shut-down feed-wheel 1-2, if necessary. This control block may be a special purpose hardware controller built with conventional logic and sequencing means, (as known in the art), or it may be a microprocessor with a set of stored programs for executing the foregoing.

FIG. 3 illustrates preferred logic (steps) for so shifting roller 1-3P toward/away from roller 1-3D and so adjust $F_p$- - - e.g., in terms of what edge-detector 1-4 reveals about inter-document gap size. FIGS. 3 provides a logic flow diagram which is largely self-explanatory. In keeping with conventional flow diagram techniques, where a question (or test) exists in a block, (such as block 3-1), if the answer is "Yes", control follows the "YES" branch (in this case back to block 3-1) and if the answer is "NO", then control follows that branch (in this case to block 3—3).

FIG. 3 controls the document acceleration to so change gap-size between documents, by sensing gap-size (at detector 1-4). Workers will appreciate that, here, one need not assume that the documents are being moved past sensor 1-4 at a fixed speed. Thus, in FIG. 3, when detector 1-4 detects an inter-check gap shorter than a prescribed length ("underspace"; e.g., less than 2 inches for a nominal 6-inch check length), then it will process this data and signal "underspace" to logic block 2-3.

Here, assume an "initial" document D-1 has been advanced along path f-p until its trailing-edge TE passes detector 1-4. Thereupon, timing means measure the "gap-time" $t_g$ until the leading-edge of the next document (D-2) passes detector 1-4. The control (computer) translates this time $t_g$ into gap-size.

Whenever a trailing-edge is detected followed by a leading-edge, block 2-3 will be queried (by computer program, under cycle-clock) and, if no gap deviation is found (YES, FIG. 3), then simply end the cycle (loop back to START at 3-1). If NO (indicating variation detected), then block 2-3 will be triggered to not change the force applied to pinch roll 1-3P.

Gap Detection (Summary of FIG. 2 Operation)

Edge Detector 1-4 may be spaced (adjustably) downstream from Feed Wheel 1-2 virtually any convenient distance. Only one edge detector, B in this case, is needed to measure the gap between documents. The edge detector, usually photoelectric, can detect whether a leading edge or trailing edge passes it by electronic logic, or by a computer sensing whether the voltage from the detector falls or rises. Usually this voltage falls or rises very rapidly, so there is no appreciable document movement during these changes. Assuming the documents pass the detector at constant speed, the logic can determine the gap by measuring the time between a falling and rising voltage using an electronic clock, as workers know.

The system employed can accurately adjust to the desired rate regardless of the length of documents being fed; that is, a feed rate and gap can be specified for nominal-length document and the system can be adjusted for different-length documents - - - i.e., even without any nominal-length documents being present.

Figure 4:
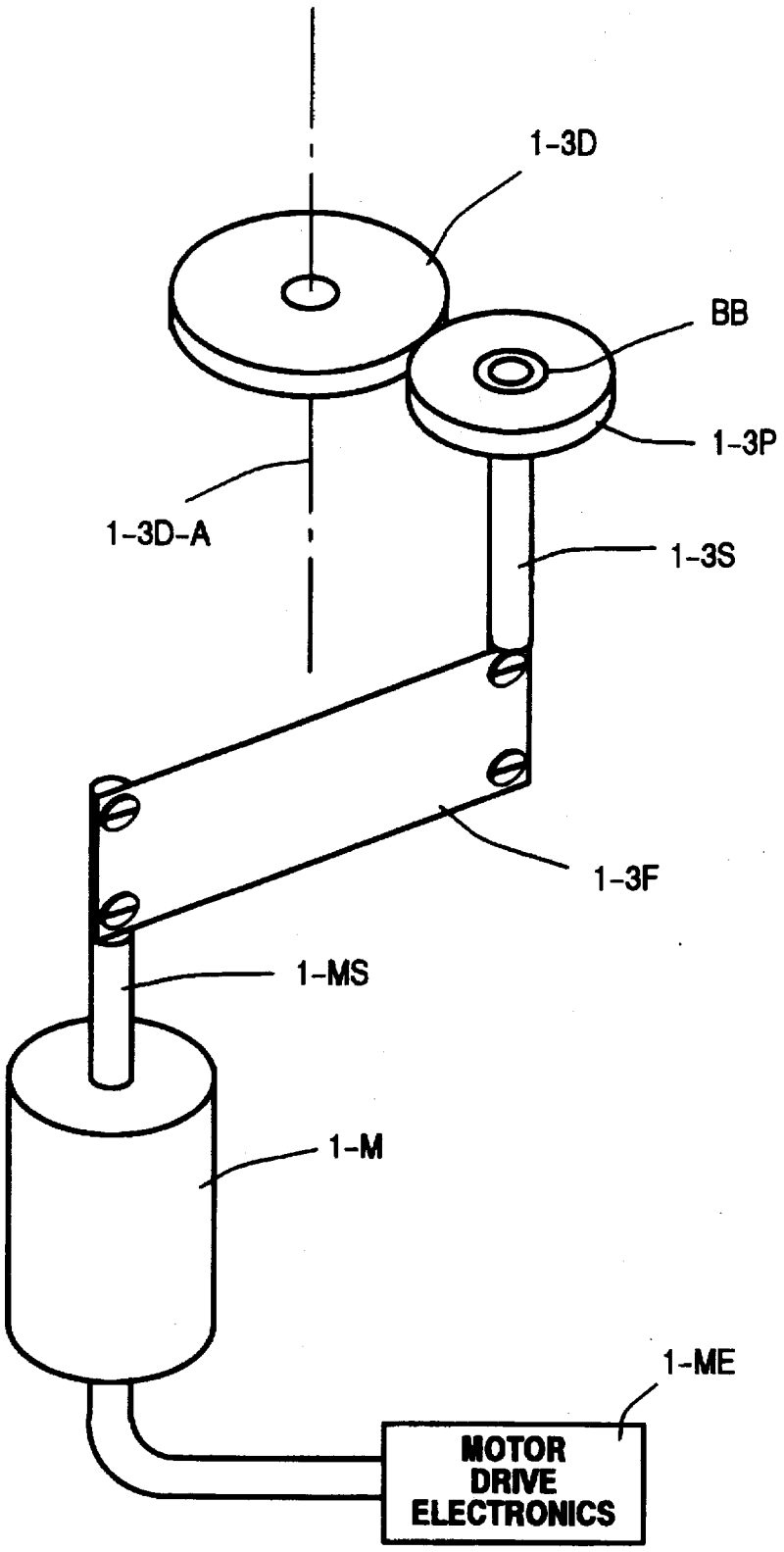
FIG. 4 illustrates a preferred pinch roll arrangement for implementing this system.

FIG. 4 illustrates a preferred one of many possible implementations for varying the force applied to the pinch roller 1-3P. Here, the accelerator drive roller 1-3D will be understood as fixedly disposed and driven as known by workers. Companion accelerator pinch roller 1-3P is mounted on a shaft 1-3S which is, according to a feature hereof, arranged to be resiliently repositioned, with roller 1-3P thereon, toward and away from drive roller 1-3D, sufficient to produce the desired pinch force F upon the then-engaged document portion.

Here, and preferably, this is effected by a motor 1-M (e.g., known DC or stepper motor) controlled by a related control unit 1-ME. Preferably, motor 1-M is coupled, at its shaft 1-MS to pinch roller shaft 1-3S via a flexure 1-3F (or like resilient means) so that a given step rotation of motor shaft 1-MS will increase or decrease the nip force a certain amount, to cause it to accelerate/decelerate a document and tend to reduce gap deviation. Shaft 1-3S will be urged toward or away from drive roller (axis) 1-3D, as workers will appreciate. The accelerator drive roller 1-3D drives the document with pinch force $F_p$ supplied by the pinch roller. The pinch roller is allowed to freely rotate about the pinch roller shaft 1-3S, Pinch roller shaft 1-3S is allowed to move perpendicular to the rotation axis of the pinch roller because of the flexibility of the flexure 1-3F in this direction. This flexibility is necessary to allow for variations in document thickness and document condition, such as the presence of staples, folds, etc. Pinch roller force $F_p$ is varied by rotating the motor shaft 1-MS as mentioned.

For high-speed operation, and where a "document-bulge" is anticipated (e.g., from a staple); workers will appreciate that this system should react quickly and resiliently (e.g., allow the nip to yield and be momentarily enlarged; but then spring back quickly). For quicker spring-back, a stiffer flexure 1-3F will be preferred, one that is relatively stiff in torsion (e.g., a flexure strip of a suitable composite material, or a pair of flexure strips).

When this arrangement is activated (POWER-ON), an initial, nominal pinch roller force $F_p$ is produced by electrical stimulation to the motor 1-M that rotates the motor shaft counterclockwise in FIG. 4. After documents begin feeding into the transport path, motor shaft 1-MS may be further rotated by further electrical stimulation to vary the pinch roller force from the nominal value. If the document spacing needs to be increased, then the motor is rotated counterclockwise to increase the pinch roller force. But if document spacing needs to be decreased, then the motor shaft is rotated clockwise, decreasing the pinch roller force.

The preferred associated system for so adjusting pinch force $F_p$ is shown in FIG. 1. Here, it will be understood that an edge detector unit 2-1 is used to detect the inter-document spacing in known fashion (e.g., by sensing when the trailing edge of the previous document passes, then sensing when the leading-edge of the next document passes, and timing the interval in known fashion). An output (e.g., "s sec.") from detector 2-1 is preferably applied to a logic unit 2-3 which, in known fashion, converts this output to a gap dimension (e.g., at prevailing transport speed of 100 inches/sec., a lapse of s seconds (e.g., here five) might translate to a "gap" of 5 inches).

This unit 2-3 would also compute the "deviation" from "nominal" that this gap measurement represents (e.g., if 4" is nominal value, unit 2-3 would output "+1 inches" representing gap deviation; whereas if 6" were the norm, the output would be "−1 inches". Then, this "gap deviation output" from unit 2-3 is applied to a force control unit 2-5 to cause motor 1-M to step sufficient to increase/decrease this gap to restore the "nominal" gap value.

A preferred algorithm for implementing the foregoing is given in FIG. 3. Here, the entry step 3-1 asks for the detected dimension of the upcoming interdocument gap, and for a comparison (step 3-2) with the prescribed, "nominal" gap. If there is "No Deviation" (see "YES") then no change in pinch-force is called-for.

If there "is a Deviation", the query (step 3—3) becomes "Is the Deviation greater ("YES"), then go to step 3-4A and INCREASE pinch force $F_p$); i.e., control Motor 1-M to thrust pinch roller 1-3P TOWARD roller 1-3D); but if the DEVIATION is LESS ("No"), then go to step 3-4B and DECREASE $F_p$ (i.e., control Motor 1-M to pull pinch roller 1-3P AWAY from roller 1-3D)

Results

It will be apparent that any aforedescribed invention is apt for effecting the objects mentioned; e.g., to adjust inter-document gap with variable-speed transport means disposed intermediate the input (feed-end) and output (use-stations) of a transport path; e.g., to correct occasional small gap variations that may occur due to improper feed-in or from document slip at initial upstream mechanisms.

It will be evident that this spacing correction is performed by automatically changing transport speed (accelerate/decelerate) at an "intermediate" transport segment preferably while a document is being advanced (e.g., by feed array). Workers will recognize that since rollers, etc. in the initial transport segment often necessarily have large inertias (e.g., because of their specific functions, such as aligning or feeding), these inertias make it impractical, or difficult, to decelerate documents therewith by way of correcting (increasing/decreasing) document-spacing. Accordingly, this is better done with an "upstream", "intermediate" transport segment, as here described.

Of course, many modifications to the preferred embodiment described previously are possible without departing from the spirit of the present invention. For example, there are many different ways to provide controls as described in the present invention, and it is not limited to the particular types of sensors or the particular types of advance means. As a further example, the feedback control in its preferred embodiment is described as a software algorithm, but it is well known that the same functions can be accomplished using known hardware. Additionally, some features of the present invention can be used to advantage without the corresponding use of other features.

Accordingly, the description of the preferred embodiment should be to be considered as including all possible modifications and variations coming within the scope of the invention as defined by the appended claims.

What is claimed is:

1. Apparatus for processing documents by moving the documents from an input hopper along a given path via advance means to a destination at a controlled rate, and including:

picker means for picking successive documents from said input hopper and advancing them via said advance means along a given feed path at an adjustable time period after a previous document had been so picked, to thus establish a "nominal" inter-document gap-distance value $g_n$;

sensor means for sensing the distance d between each so-picked document and the following document; control means for comparing said distance d with said nominal gap $g_n$ and establishing a prescribed preselected variance-distance $\Delta d$ from said nominal gap; said control means thereupon causing said advance means to accelerate or decelerate the succeeding document to thereby apply the sensed variation $\Delta d$ from said nominal gap; and said control means also operating so that the next pick time is automatically set by deriving and storing a value g representing the instantaneous associated pick gap-distance and converting this to a delay-pick time value;

said control means further operating to compare the stored gap value with stored values representing the desired nominal gap value; and to thereupon adjust the acceleration or deceleration of said advance means to drive said instantaneous gap value g toward said nominal gap value, whereby the number of documents passing through the system per unit time may be controlled and maximized.

2. The apparatus of claim 1, wherein said control means is also arranged to also prescribe a minimum inter-document gap $g_m$, and, when an "under-gap" $g_u$ that is less than gap $g_m$, is detected by said sensor means to decelerate the document following to reduce gap variance; and wherein said apparatus also includes undergap-monitor means to detect and register a repeated occurrence of said undergap condition for N successive documents, and when such is detected, to responsively stop said picker means for a suitable delay time.

3. Apparatus for transporting and processing documents and maintaining a preset nominal inter-document gap, $g_{nom}$ therebetween, this apparatus including transport means for picking each document from an input stack and advancing it toward a destination at a controlled rate; sensor means for sensing the gap distance g between the so-moved document and the following document; and control means for determining the variance $\nabla g$, between g and $g_{nom}$ while driving each successive document along a feed path from said input stack at adjustable times; with said sensor means inputting data to said control means which is adapted to responsively determine said variance-distance $\nabla g$, and to thereupon control said transport means to adjust the acceleration or deceleration of the said following document whereby to tend to reduce this variance-distance $\nabla g$.

4. The apparatus of claim 3, wherein said control means is arranged to preset a minimum inter-document gap $g_m$ and to detect when a gap g less than $g_m$ occurs; and to responsively control said transport means to delay the next document-pick sufficient to tend to reestablish said nominal gap value $g_{nom}$.

5. The apparatus of claim 3, wherein said control means is arranged to determine when gap distance g, as sensed by said sensor means, is greater than said nominal gap value $g_{nom}$ and to responsively cause said transport means to time the next document-pick so as to tend to reestablish gap $g_{nom}$.

6. The apparatus of claim 3, wherein said control means is arranged to determine, responsive to input from said sensor means, when said variance distance $\nabla g$ exceeds a prescribed preset maximum gap-variation $\nabla g_{max}$ times and is adapted to responsively issue a warning signal indicating such.

7. The apparatus of claim 6, wherein said control means, upon issuing said warning signal, is further adapted to thereupon stop said picking/advancement by said transport means.

* * * * *